United States Patent [19]

Maurer et al.

[11] Patent Number: 4,469,214

[45] Date of Patent: Sep. 4, 1984

[54] APPARATUS FOR MOVING SPINNING CANS

[75] Inventors: Andreas Maurer, Winterthur; Gerhard Mandl, Bruetten; Hanspeter Meile, Winterthur, all of Switzerland

[73] Assignee: Rieter Machine Works Limited, Winterthur, Switzerland

[21] Appl. No.: 451,536

[22] Filed: Dec. 20, 1982

[30] Foreign Application Priority Data

Dec. 22, 1981 [CH] Switzerland ..... 8219/81

[51] Int. Cl.[3] ..... B65G 47/00

[52] U.S. Cl. ..... 198/339; 198/570; 198/742; 198/487; 57/281

[58] Field of Search ..... 198/740, 741, 742, 580, 198/487, 339, 746, 748; 414/749, 750; 57/281; 19/159 A

[56] References Cited

U.S. PATENT DOCUMENTS

| | | | |
|---|---|---|---|
| 3,478,859 | 11/1969 | Krempel et al. | 198/472 |
| 3,808,641 | 5/1974 | Schneider et al. | 19/159 A |
| 4,042,093 | 8/1977 | Fujii et al. | 198/339 |
| 4,365,388 | 12/1982 | Mori et al. | 19/159 A |

*Primary Examiner*—Joseph E. Valenza
*Assistant Examiner*—Kyle E. Shane
*Attorney, Agent, or Firm*—Werner W. Kleeman

[57] ABSTRACT

In a can changer device, empty cans are fed to a reserve position A and full cans are transported from a collection position C into a delivery position G by means of an apparatus for moving spinning cans. The can moving apparatus comprises drive means containing rails and a carriage movable thereon and having pivotably mounted arms. The arms are pivotable from a substantially vertical position, and specifically, to one side into a substantially horizontal position for entraining and moving the empty cans and, as to one arm of such arms, into the opposite substantially horizontal position for entraining and moving the full can. The carriage is movable to-and-fro by means of a toothed belt between a deflection or reversing head and a drive head, respectively between the locations or positions H and L. During operation, the can changer device itself moves the filled can from the position B towards the position C and the empty can from the position A into the position B. The can moving apparatus thereafter moves the full can from the position C into the position G, whereafter the one arm is pivoted back into the vertical position and the carriage is moved into the location of position L in order to thereafter move the empty cans into the positions F and $F^I$, and simultaneously, to move the preceding cans to such an extent that an empty can has again reached the reserve position A. Thereafter, the arms are again pivoted back into the subtantially vertical position and the carriage is returned back into the waiting location or position I.

9 Claims, 5 Drawing Figures

APPARATUS FOR MOVING SPINNING CANS

CROSS-REFERENCE TO RELATED APPLICATION

This application is related to the commonly assigned, copending U.S. application Ser. No. 06/451,448, filed Dec. 17, 1982, entitled METHOD AND APPARATUS FOR MOVING SPINNING CANS.

BACKGROUND OF THE INVENTION

The present invention relates to a new and improved construction of apparatus for displacing or moving spinning cans by means of arms or arm members which are pivotably and linearly movable by a drive means for the purpose of entraining and moving the cans along the drive means.

Such type of equipment is predominantly used as infeed devices for infeeding empty cans to spinning preparatory machines, particularly to drawing frames. The removal of the cans which have been filled at the drawing frame also can be accomplished by the same type of devices.

As a general rule, in order to accomplish both of these functions there is required a respective infeed device and an outfeed or transporting-away device.

In German Utility Pat. No. 6,918,312 there is disclosed an apparatus wherein two empty spinning cans are entrained by an arm member which is pivotably and linearly movable by a drive means, and these two empty spinning cans are conjointly moved out of a magazine for empty cans into a filling position of a drawing frame. Movement of the full cans is accomplished by a second device in a direction of movement which is essentially at right angles to the empty cans. One of the notable drawbacks of this prior art arrangement resides in the large space requirements which is predicated upon the displacement stroke of the second device for removing the full cans as well as in the limited displacement length of the full cans owing to a limited displacement stroke.

SUMMARY OF THE INVENTION

Therefore, with the foregoing in mind it is a primary object of the present invention to provide a new and improved construction of apparatus for moving or displacing spinning cans which is not afflicted with the aforementioned drawbacks and limitations of the prior art heretofore discussed.

Another and more specific object of the present invention is directed to a new and improved construction of apparatus for positively and reliably moving spinning cans, which apparatus is relatively simple in construction and design, quite economical to manufacture, extremely reliable in operation, not readily subject to breakdown or malfunction, requires a minimum of maintenance and servicing, is quite compact and requires a relatively small amount of space.

Now in order to implement these and still further objects of the invention, which will become more readily apparent as the description proceeds, the can moving apparatus of the present development is manifested by the features that there are provided three arms or arm members, one of the arm members being pivotable substantially through an angle of 180° for entraining and moving cans at both sides of the drive means, and the two additional arm members are pivotable substantially through an angle of 90° for entraining and moving cans at one side of the drive means.

Some of the more notable advantages realized with the invention reside in the fact that the empty cans and the full cans can be respectively fed to and removed from a drawing frame with optimum utilization of the available space, and additionally, the can moving apparatus can be combined with a can feed element or device which is located substantially at right angles to the direction of movement of the can moving apparatus.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
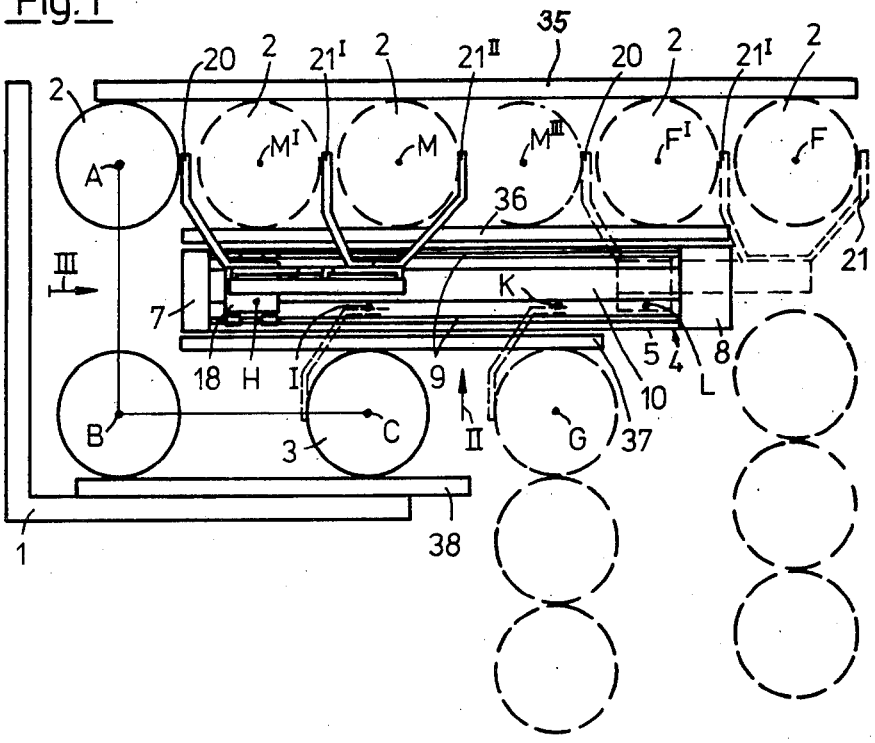
FIG. 1 is a top plan view, shown partially schematically, of a can moving or displacement apparatus according to the invention in combination with a can changing or changer device.

Describing now the drawings, it is to be understood that only enough of the construction of the can moving apparatus and the related can changing or changer device has been shown as needed for those skilled in the art to readily understand the underlying principles and concepts of the present development, while simplifying the illustration of the drawings. Turning attention now to FIG. 1, in a not here further described but conventional can changing or changer device 1, an empty can 2, is transported by the can changing or changer device 1 itself from a reserve position A into a position B for filling of the empty can 2 and thereafter the filled can 3 is moved into a collection or retrieving position C.

Figure 3:
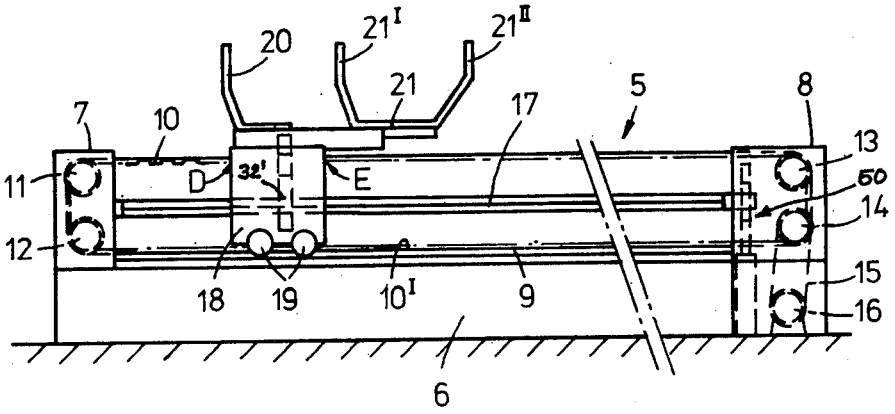
FIG. 3 is a side view, again partially schematically shown, of the can moving apparatus depicted in FIG. 1 looking essentially in the direction of the arrow II thereof.
Figure 4:
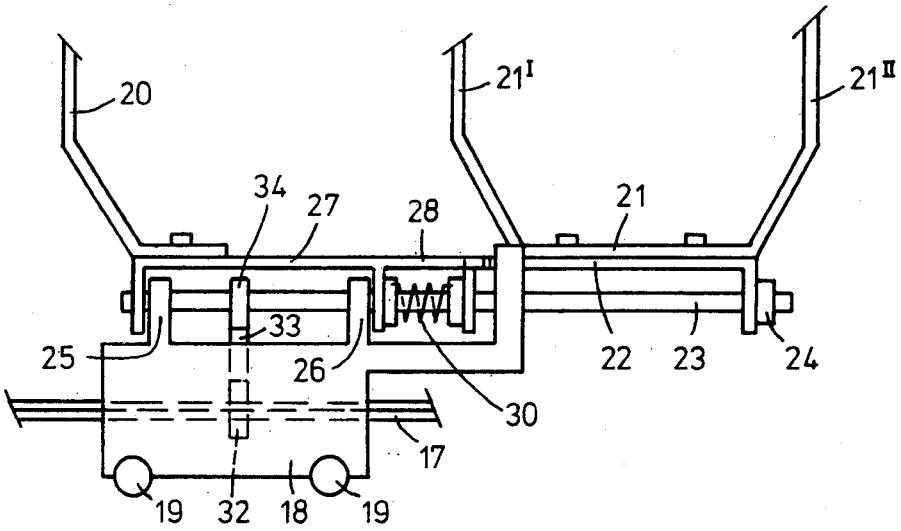
FIG. 4 is an enlarged semi-schematic illustration of a detail of the can moving apparatus of FIG. 3 shown in side view and looking essentially in the direction of the arrow IV of FIG. 5.
Figure 5:
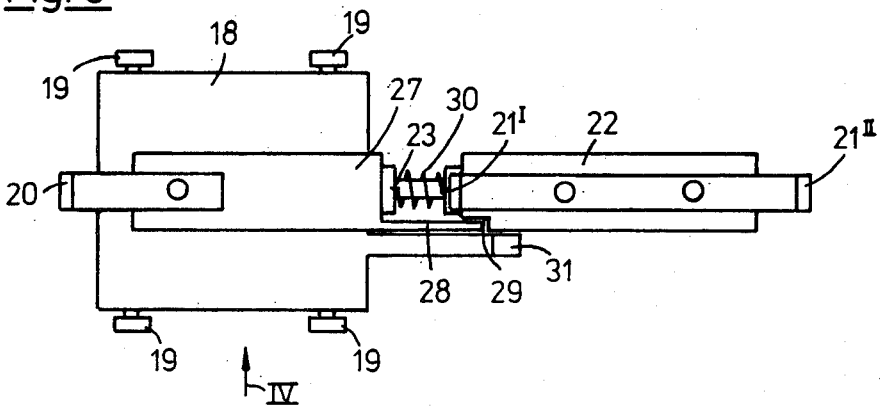
FIG. 5 is a top plan view illustrating a detail of the arrangement of FIG. 4.

A can moving or displacement device 4 for moving spinning cans will be seen to comprise a drive means 5 containing a base or support member 6 supporting a deflection or reversing head 7 and a drive head 8. Between the deflection or reversing head 7 and the drive head 8 there are disposed fixedly arranged rails or tracks 9, of which only one thereof is specifically visible in the showing of FIG. 3. Additionally, the drive means 5 comprises a drive element, here shown in the form of a toothed belt 10 which is guided in the deflection or reversing head 7 by the deflection or diverting rolls or rollers 11 and 12 and in the drive head 8 by the deflection or diverting roll 13 and a drive roll 14. The drive roll or roller 14 is driven by means of a suitable transmission or power transmitting element 15 from a suitable drive motor 16. Further, the drive means 5 will be seen to comprise a multi-cornered, here a quadrangular or rectangular shaft 17 which is rotatably supported in the deflection or reversing head 7 and the drive head 8 and which is driven in the drive head 8 by means of a pneumatic cylinder unit equipped with a rack which meshes with a pinion secured to this shaft 17 for driving the shaft 17. In the illustration of FIG. 3, the pneumatic cylinder unit, rack and pinion have been shown in outline with dotted lines in the drive head 8 and in the base member 6, and have been generally indicated by reference characters 50.

Figure 2:
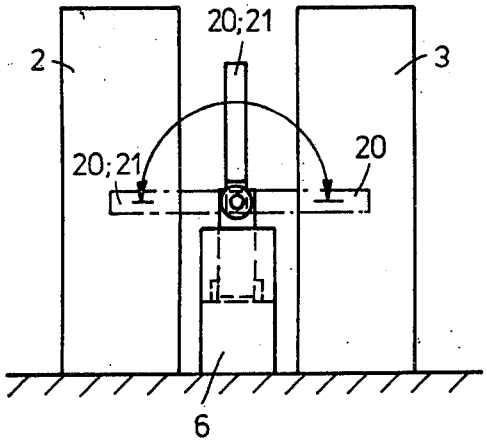
FIG. 2 is a front view, again partially schematically illustrated, of the can moving apparatus depicted in FIG. 1, looking in the direction of the arrow III thereof.

A carriage 18 or equivalent structure, illustrated in a simplified manner in FIGS. 1, 2 and 3, is movable along the rails 9 by means of four wheels or rollers 19, only two of which are visible in FIG. 3, and is supported by any suitable alignment facilities in the direction of travel against diversion out of its prescribed direction of travel. The toothed belt 10 is fixedly secured at the locations D and E with the carriage 18. The lower run $10^I$ of the tooth belt 10 is guided beneath the carriage 18 and between the four wheels 19.

This carriage 18 further comprises an arm or arm member 20 and a double arm or arm member 21 having the arm portions $21^I$ and $21^{II}$. The arm member 20 is mounted for pivotal movement from a substantially vertical initial position into selective positions to both sides of the drive means 5, that is to say, towards both the empty cans and the full cans, while the double arm member 21 is pivotable from the same initial vertical position only to the one side of the drive means 5, here the side thereof directed towards the empty cans.

The double arm member 21 is fixed to a bracket or yoke 22 which is freely supported and pivotably mounted on a shaft 23 and is secured against axial movement in one direction by an abutment or stop 24. This pivot shaft or shaft member 23, in turn, is rotatably supported in bearing blocks 25 and 26 forming part of the carriage 18. Further, the arm member 20 is secured to a bracket or yoke 27 which is fixedly connected to the shaft 23.

An entrainment member or dog 28 belonging to the bracket or yoke 27 engages into a recess 29 provided in the bracket or yoke 22. Also, the brackets or yokes 27 and 22 are elastically or resiliently connected with one another by means of a suitable connection element, here shown as a torsion spring 30.

An abutment or stop 31 forming part of the carriage 18 prevents the bracket or yoke 22 from pivoting the arms $21^I$ and $21^{II}$ out of the substantially vertical position towards the full cans.

The shaft 23 is driven from the shaft 17 by means of mutually meshing gears 32, 33 and 34, the gears 32 and 33 being secured against axial movement and being rotatably supported in the carriage 18, and the gear 34 is fixedly secured upon the shaft 23. Furthermore, the gear 32 is provided with a quadrangular or multi-cornered opening, generally indicated by reference character 32', which is complementary to the quadrangular or rectangular shaft 17 in a manner such that a transfer of force can occur between the shaft 17 and the gear 32, but nonetheless the gear 32 is movable upon the shaft 17.

The pivoting of the arm member 20 and the double arm member or arms 21 occurs in the following manner.

If the arm member 20 is pivoted to the right of the showing of FIG. 2 in order to engage and seize a full can, then the bracket 22 remains against the abutment or stop 31 and the entrainment member or dog 28 releases from the recess 29 or equivalent structure.

If, on the other hand, empty cans are to be moved, then the bracket or yoke 27 is pivoted towards the left of the showing of FIG. 2, and with the aid of the entrainment member or dog 28, entrains the bracket or yoke 22 into the same position. In order to prevent the bracket or yoke 22 from tilting against the empty cans 2 when released by the entrainment member or dog 28, the spring 30 is pretensioned in such a manner that the entrainment member or dog 28 rests in the recess 29 in the vertical position and also during pivoting towards the left in the direction of the empty cans.

For respectively guiding the empty and full cans, as shown in FIG. 1 there are provided the respective guide rails 35, 36, and 37, 38, which are secured to the ground or floor.

FIG. 1 illustrates the use of the can moving apparatus for a situation where only two remaining empty cans 2 represented by circles shown in dotted or phantom lines, are to be moved from respective readiness positions F and $F^I$ into respective intermediate positions M and $M^I$, and at the same time a preceding empty can 2, shown by a circle in broken lines, is to be moved from an intermediate position $M^I$ into the reserve position A, and a full can 3 is to be moved from the collection position C into the delivery position G.

Such procedure is preceded by the movement of a full can 3 from the filling position B into the delivery position C, and an empty can 2 is moved from the reserve position A into the filling position B by the can changer device 1.

During operation, after the can changer device 1 has automatically moved the can from the filling position B into the collection position C, any suitable control system causes the vertically positioned arm member 20 (FIG. 3) of the carriage 18, which is located in a waiting position or location I (FIG. 1), to pivot towards the right as viewed in the direction III of FIG. 1 in order to entrain the can 3 located in the collection position C, and thereafter upon movement or shifting of the carriage 18 to move this can 3 from the collection position C into the delivery position G. In this position, the carriage 18 has reached the location or position K where the arm member 20 is again pivoted back into the substantially vertical position. Thereafter, the carriage 18 travels further into an extreme end or terminal location or position L in order that, by pivoting of the arm members or arms 20, $21^I$ and $21^{II}$ towards the left of the showing of FIG. 2, there are entrained respective empty cans 2 placed in readiness in the positions F and $F^I$, respectively, and thereafter to move these cans 2 into the positions M and $M^I$, respectively, during the course of the oppositely directed return movement of the carriage 18 towards the location or position H. At the same time, the preceding empty can 2 is moved from the position M by means of the arm member 20 into the position A. Thereafter, the arm members 20, $21^I$ and $21^{II}$ are again brought back into their substantially vertical position and the carriage 18 is again moved back into the waiting position or location I.

In the event that no further cans 2 are to be supplied into the positions F and $F^I$, then the complete above-described procedure is repeated twice until the last empty can 2 has reached the position or location A. During the course of this operation the can 2 is moved further from the position M against the preceding can in the position $M^I$, and thereafter both cans are further moved until the can from the position $M^I$ has reached the position A. During the last described operation, the last can is finally moved by the arm member 20 into the reserve position A.

By virtue of this maneuver, the reserve position A is again provided with an empty can 2, and the collection position C is again free for the supply of the full can 3.

The above-mentioned maneuvers occur during the time when the can is filled at the filling position B.

In normal use, during which an empty can 2 is continuously supplied into the position F, there is formed a row of successive empty cans which extend up to the position $M^{III}$, which can be displaced for such length of time by means of the arm member 20 while simultaneously displacing the cans in the positions F and $F^{I}$ until an empty can has again reached the reserve position A.

While there are shown and described present preferred embodiments of the invention, it is to be distinctly understood that the invention is not limited thereto, but may be otherwise variously embodied and practiced within the scope of the following claims.

What we claim is:

1. An apparatus for moving spinning cans comprising:

a plurality of pivotably and linearly displaceable arm members for engaging and displacing cans along a drive means;

drive means for pivotably and linearly displacing said arm members;

said plurality of arm members comprising three arm members;

one of said arm members being pivotable essentially through an angle of approximately 180° for engaging and displacing cans to both side of the drive means;

both of the other arm members being pivotable essentially through an angle of approximately 90° and displacing cans at one side of the drive means; and both of said other arm members protruding beyond said drive means in an extreme end location thereof.

2. The apparatus as defined in claim 1, wherein:

said drive means serves to drive the arm member which is pivotable through an angle of approximately 180° for pivoting said last-mentioned arm member to both sides of said drive means;

entrainment means for driving said other two arm members;

said entrainment means being provided on said one arm member pivotable through approximately 180° for simultaneously pivoting all three arm members to the same side of said drive means; and means for returning said other two arm members into a substantially vertical initial position.

3. The apparatus as defined in claim 2, wherein:

said returning means comprises a spring connecting the one arm member and said other two arm members.

4. The apparatus as defined in claim 1, wherein:

said drive means comprises:

rail means; and carriage means movable upon said rail means and serving for pivotably receiving said arm members.

5. The apparatus as defined in claim 4, wherein:

said drive means comprises a toothed belt extending at least over the full extent of movement of said carriage means for moving said carriage means.

6. The apparatus as defined in claim 4, wherein said drive means comprises a substantially multi-cornered shaft serving as a drive element for pivoting of said arm members;

said multi-cornered shaft extending at least over the extent of movement of said carriage means; and stationary drive means for driving said multi-cornered shaft.

7. The apparatus as defined in claim 5, further including:

stationary drive means for drivingly connecting said toothed belt with said carriage means.

8. The apparatus as defined in claim 1, wherein:

said can moving apparatus is combined with a can changer device in a manner such at one side of said drive means empty cans are fed to the can changer device and at the other side of said drive means full cans are removed from the can changer device.

9. The apparatus as defined in claim 1, further including:

a can feeding element combined with said can changing device and arranged substantially at right angles thereto and at both sides of which cans are continuously supplied and transported away, respectively.

* * * * *